US006481169B1

(12) United States Patent
Ludwig et al.

(10) Patent No.: US 6,481,169 B1
(45) Date of Patent: Nov. 19, 2002

(54) PREFABRICATED FURNITURE SYSTEM

(75) Inventors: James Ludwig, East Grand Rapids; Kurt R. Heidmann, Grand Rapids; Dean K. Hubbard, Byron Center, all of MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/694,296

(22) Filed: Oct. 23, 2000

(51) Int. Cl.[7] ..... E04H 1/00

(52) U.S. Cl. ..... 52/239; 52/36.1; 52/220.7; 52/481.2; 52/731.5; 52/731.7; 52/745.1; 160/351

(58) Field of Search ..... 52/239, 283.1, 52/36.1, 36.2, 220.7, 481.2, 489.1, 731.5, 731.7, 745.1, 745.13; 160/351, 377

(56) References Cited

U.S. PATENT DOCUMENTS

| | | | | |
|---|---|---|---|---|
| 3,771,273 | A | | 11/1973 | Brodie |
| 4,437,278 | A | * | 3/1984 | Thomas, Jr. ..... 52/239 |
| 4,606,394 | A | * | 8/1986 | Bannister ..... 160/351 |
| 4,907,388 | A | * | 3/1990 | Siahatgar ..... 52/481.2 |
| D345,063 | S | | 3/1994 | Golod et al. |
| 5,394,658 | A | | 3/1995 | Schreiner et al. |
| 5,511,348 | A | | 4/1996 | Cornell et al. |
| 5,675,949 | A | | 10/1997 | Forslund et al. |
| 5,768,840 | A | | 6/1998 | Feldpausch et al. |
| 5,784,843 | A | | 7/1998 | Greer et al. |
| 5,813,174 | A | * | 9/1998 | Waller ..... 52/79.1 |
| 5,816,000 | A | * | 10/1998 | Izatt et al. ..... 52/238.1 |
| 5,899,025 | A | | 5/1999 | Casey et al. |
| 5,950,371 | A | | 9/1999 | Rives et al. |
| 5,974,742 | A | | 11/1999 | Schreiner et al. |
| 6,067,762 | A | | 5/2000 | Greer et al. |
| 6,073,399 | A | | 6/2000 | Shipman et al. |
| 6,082,065 | A | * | 7/2000 | Feldpausch ..... 52/239 |
| 6,112,472 | A | | 9/2000 | VanDyk et al. |
| 6,128,873 | A | | 10/2000 | Shipman et al. |
| 6,151,852 | A | * | 11/2000 | Linn et al. ..... 52/239 |
| 6,170,200 | B1 | | 1/2001 | Cornell et al. |
| 6,216,397 | B1 | * | 4/2001 | Chang ..... 52/36.1 |
| 6,216,398 | B1 | * | 4/2001 | Shipman et al. ..... 52/36.1 |
| 6,226,931 | B1 | * | 5/2001 | Haversat ..... 52/71 |
| 6,247,272 | B1 | * | 6/2001 | Shipman ..... 52/29 |
| 6,279,643 | B1 | * | 8/2001 | Shipman ..... 160/351 |

FOREIGN PATENT DOCUMENTS

| | | |
|---|---|---|
| WO | WO0021412 | 4/2000 |

OTHER PUBLICATIONS

"Good Stuff" by Herman Miller, Inc., Zeeland, Michigan (22 pages) dated 2000.

* cited by examiner

*Primary Examiner*—Carl D. Friedman
*Assistant Examiner*—Brian E. Glessner
(74) *Attorney, Agent, or Firm*—Price, Heneveld, Cooper, DeWitt & Litton

(57) ABSTRACT

A prefabricated furniture system for open building plans and the like includes a freestanding portable partition system having individual partition panels detachably interconnected side-by-side to define individual workstations. A post and beam furniture system is also included, having horizontal beams interconnected to define an overhead framework, and vertical support columns with lower ends abuttingly supported on the building floor surface, and upper ends connected with the overhead framework adjacent one end thereof. A connector system connects the overhead framework to the upper ends of the partition panels at a location spaced inwardly from the opposite end of the overhead framework, such that the horizontal beams at that end of the overhead framework extend over and protrude outwardly from the partition panels and are supported thereby in a cantilevered fashion. A panel stabilizer connector may be provided to detachably interconnect one or more of the partition panels with an adjacent one of the support columns to provide lateral rigidity to the partition system.

38 Claims, 8 Drawing Sheets

PREFABRICATED FURNITURE SYSTEM

CROSS-REFERENCE TO RELATED APPLICATIONS

The present application is related to commonly assigned, co-pending U.S. patent application Ser. No. 09/694,645, entitled Leveling System For Post And Beam Furniture Systems and The Like, which is hereby incorporated herein by reference.

BACKGROUND OF THE INVENTION

The present invention relates to furnishings for open office spaces and the like, and in particular to a prefabricated furniture system therefor.

Portable partition systems for open office spaces and other similar settings are well known in the art. Individual partition panels are interconnected in different configurations to form separate offices, workstations and/or work settings. The partition panels are extremely durable and can be readily disassembled and reassembled into alternative configurations to meet the ever-changing needs of the user. Examples of such partition systems are provided in U.S. Pat. Nos. 3,822,146; 3,831,330 and 4,144,924, which are owned by Steelcase Development Inc., the assignee of the present application.

Post and beam furniture systems have also been developed to divide open plans three-dimensionally into individual workstations and/or work settings. Examples of such furniture systems are provided in U.S. Pat. Nos. 6,003,275; 5,950,371 and 5,899,025, which are also owned by Steelcase Development Inc., the assignee of the present application.

Changing technology and changing work processes demand that current office furnishing be readily adaptable to efficiently support the ever-changing needs of workers, such that the physical and functional integration of freestanding partition panel systems and post and beam furniture systems is desired to meet these needs.

SUMMARY OF THE INVENTION

One aspect of the present invention is a prefabricated furniture system for open building plans and the like which includes a freestanding portable partition system having individual partition panels detachably interconnected side-by-side to define individual workstations. A post and beam furniture system is also included, having a plurality of horizontal beams interconnected to define an overhead framework with first and second end portions, and a plurality of vertical support columns having lower ends thereof abuttingly supported on the floor surface, and upper ends thereof connected with the overhead framework adjacent at least the first end portion thereof to support the first end portion of the overhead framework on the support columns a predetermined spaced apart distance above the floor surface and below the ceiling. A connector system connects the overhead framework to the upper ends of the partition panels at a location spaced inwardly from the second end portion of the overhead framework, such that the horizontal beams at the second end portion of the overhead framework extend over and protrude outwardly from the partition panels and are supported thereon in a cantilevered fashion.

Another aspect of the present invention is a method for furnishing opening building plans and the like of the type having a ceiling and a floor surface. A freestanding portable partition system is provided of the type including a plurality of individual partition panels having lower ends thereof adapted to be abuttingly supported on the floor surface, and upper ends thereof adapted to be positioned a spaced apart distance from the ceiling. The partition panels are detachably interconnected in a side-by-side fashion to define individual workstations. A post and beam furniture system is provided of the type including a plurality of horizontal beams interconnected to define an overhead framework with first and second end portions, and a plurality of vertical support columns having lower ends thereof adapted to be abuttingly supported on the floor surface, and upper ends thereof adapted to be connected with the overhead framework. The support columns are positioned at preselected locations on the floor surface, and upper ends thereof are detachably connected with the horizontal beams at the first end portion of the overhead framework to support the same a predetermined spaced apart distance above the floor surface and below the ceiling. The overhead framework is connected to the upper ends of the partition panels at a location spaced inwardly from the second end of the overhead framework, such that the horizontal beams at the second end portion of the overhead framework extend over and protrude outwardly from the partition panels and are supported thereon in a cantilevered fashion.

Yet another aspect of the present invention is a prefabricated furniture system for open building plans and the like of the type having a ceiling and a floor surface. A freestanding portable partition system includes a plurality of individual partition panels having lower ends thereof abuttingly supported on the floor surface, upper ends thereof spaced apart from the ceiling, and opposite sides detachably interconnected in a side-by-side fashion to define individual workstations. A post and beam furniture system includes a plurality of horizontal beams interconnected to define an overhead framework, and a plurality of vertical support columns having lower ends thereof abuttingly supported on the floor surface, and upper ends thereof connected with the overhead framework to support the overhead framework on the support columns a predetermined spaced apart distance above the floor surface and below the ceiling. A panel stabilizer connector detachably connects at least one of the partition panels with a vertical side of an adjacent one of the support columns to provide lateral rigidity to the partition system.

Yet another aspect of the present invention is a method for furnishing open building plans and the like of the type having a ceiling and a floor surface. A freestanding portable partition system is provided of the type including a plurality of individual partition panels having lower ends thereof adapted to be abuttingly supported on the floor surface, and upper ends thereof adapted to be positioned a spaced apart distance from the ceiling. The partition panels are detachably interconnected in a side-by-side fashion to define individual workstations. A post and beam furniture system is also provided of the type including a plurality of horizontal beams interconnected to define an overhead framework, and a plurality of vertical support columns having lower ends thereof adapted to be abuttingly supported on the floor surface and upper ends thereof adapted to be connected with overhead framework. The support columns are positioned at preselected locations on the floor surface, and upper ends thereof are detachably connected with the horizontal beams to support the same a predetermined spaced apart distance above the floor surface and below the ceiling. A panel stabilizer connector connects at least one of the partition panels with a vertical side of an adjacent one of the support columns to provide lateral rigidity to the partition system.

The principal objects of the present invention are to provide a prefabricated furniture system that physically and functionally integrates a freestanding partition panel system with a post and beam furniture system. The prefabricated furniture system can be readily configured and rearranged to effectively accommodate a wide variety of different workspaces and/or users. A cantilevered panel support for an overhead furniture framework improves space use efficiencies, and provides an aesthetically pleasant appearance. A unique connector system permits the overhead framework to be positioned over the partition panels in a variety of different spatial relationships. T-slots in the horizontal beams and vertical support columns permit quick and easy assembly and disassembly of the various furniture parts. A panel stabilizer permits detachably connecting a partition panel to an adjacent support column for improved lateral rigidity. The prefabricated furniture system is efficient in use, capable of a long operating life, and particularly well adapted for the purposed use.

These and other advantages of the invention will be further understood and appreciated by those skilled in the art by reference to the following written specification, claims and appended drawings.

DETAILED DESCRIPTION OF THE PREFERRED EMBODIMENTS

Figure 1:
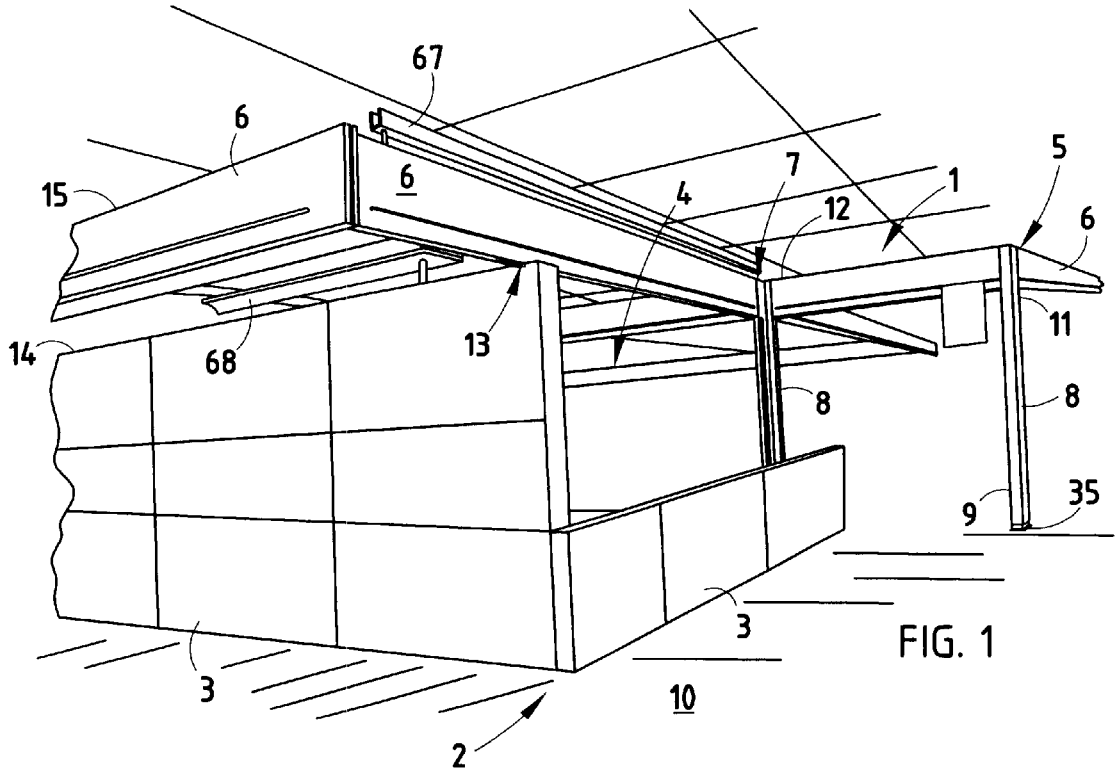
FIG. 1 is a partially schematic, fragmentary perspective view of a prefabricated furniture system embodying the present invention.

For purposes of description herein, the terms "upper", "lower", "right", "left", "rear", "front", "vertical", "horizontal" and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The reference numeral 1 (FIG. 1) generally designates a prefabricated furniture system embodying the present invention. Prefabricated furniture system 1 is designed for use in open building plans and the like, and includes a freestanding portable partition system 2 having individual partition panels 3 detachably interconnected side-by-side to define individual workstations 4. A post and beam furniture system 5 is also included, and has horizontal beams 6 interconnected to define an overhead framework 7, and vertical support columns 8 with lower ends 9 abuttingly supported on the building floor surface 10, and upper ends 11 connected with the overhead framework 7 adjacent a first end 12 thereof. A connector system 13 connects the overhead framework 7 to the upper ends 14 of the partition panels 3 at a location spaced inwardly from the opposite end 15 of overhead framework 7, such that the beams 6 at that end 15 of overhead framework 7 extend over and protrude outwardly from the partition panels 3, and are supported thereby in a cantilevered fashion.

Figure 5:
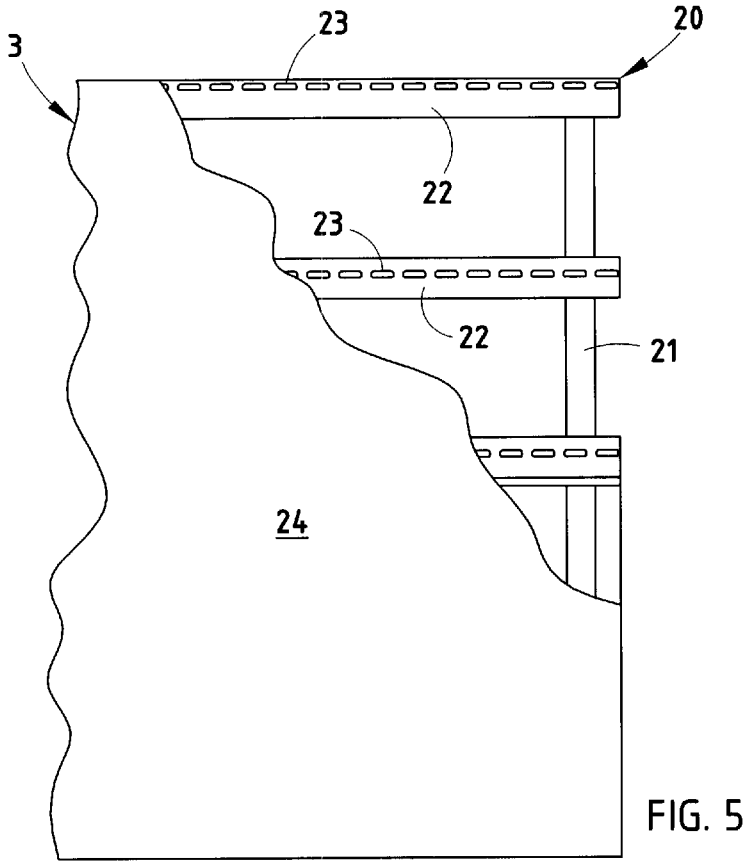
FIG. 5 is a fragmentary front elevational view of a freestanding partition panel, wherein a portion of a cover panel has been broken away to reveal internal construction.
Figure 6:
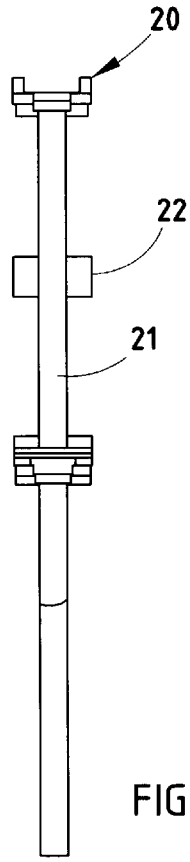
FIG. 6 is an end elevational view of a frame portion of the freestanding partition panel shown in FIG. 5.

The illustrated freestanding portable partition system 2 is of the type disclosed in U.S. Pat. No. 6,044,612, which is hereby incorporated herein by reference, and as best illustrated in FIGS. 5 and 6, includes a rigid interior frame 20, comprising a plurality of fixedly interconnected vertical frame members 21 and horizontal frame members 22. Horizontal frame members 22 include a series of horizontally oriented slots 23 to facilitate the attachment of brackets and other accessories (not shown) to frame 20. Removable cover panels 24 are detachably mounted on opposite sides of frame 20 to enclose the same.

Figure 2:
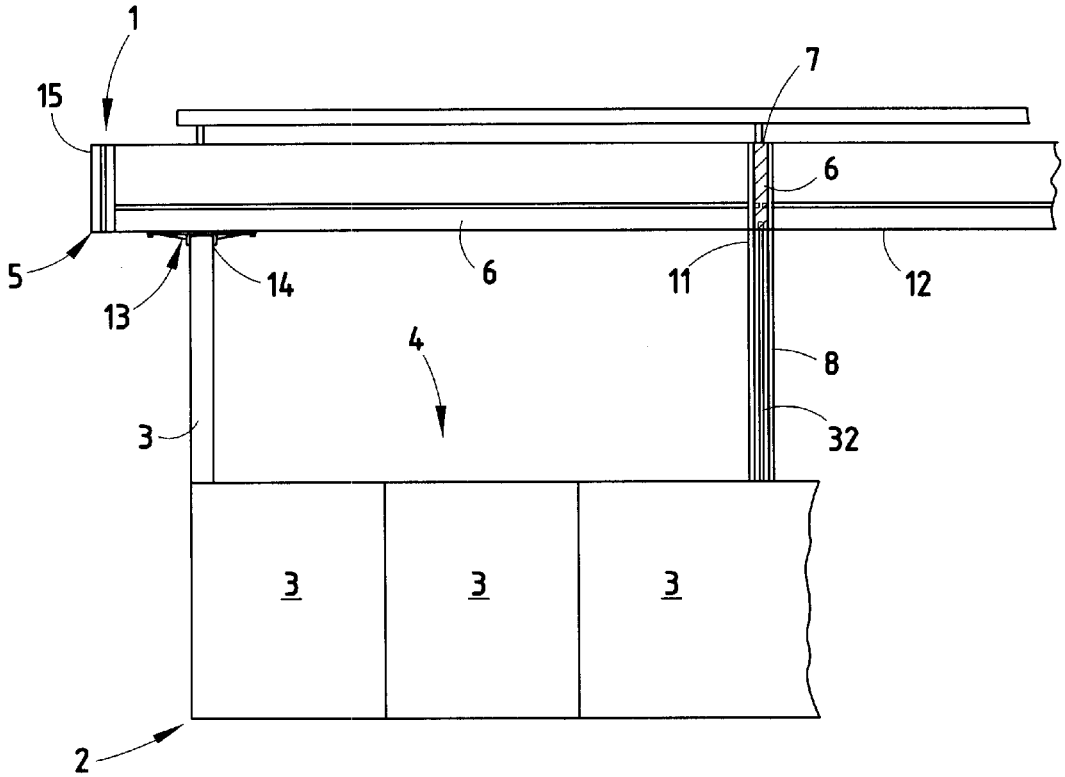
FIG. 2 is a partially schematic, fragmentary side elevational view of the prefabricated furniture system.

The illustrated post and beam furniture system 5 (FIGS. 1 and 2) is similar to that disclosed in U.S. Pat. No. 6,073,399; 6,067,761 and 5,950,371, which are hereby incorporated herein by reference, except for the shape of beams 6 and support columns 8. In the noted prior post and beam furniture systems, each post has a generally square top plan shape, with slotted corner channels that are adapted to receive therein hooks for hanging accessories. Furthermore, the beams associated with the noted prior post and beam furniture systems have a generally square construction, with a pair of inverted T-shaped hanger rails to detachably support hang-on partitions, whiteboards, displays, etc.

Figure 7:
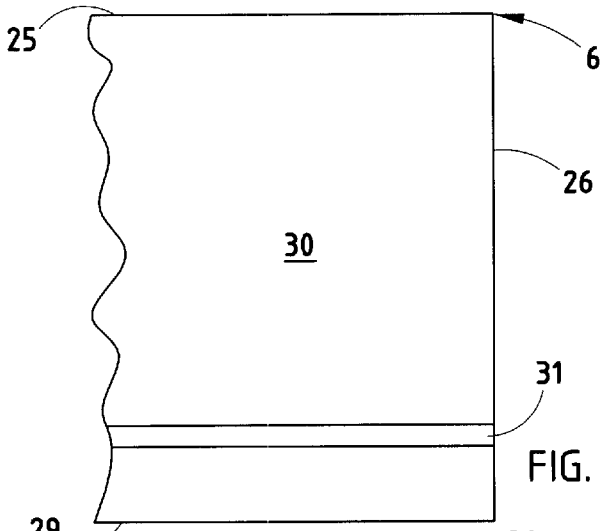
FIG. 7 is a fragmentary front elevational view of a beam portion of the prefabricated furniture system.
Figure 9:
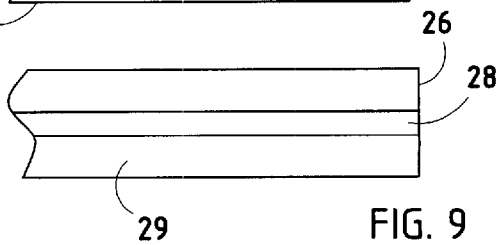
FIG. 9 is a fragmentary bottom plan view of the beam.
Figure 8:
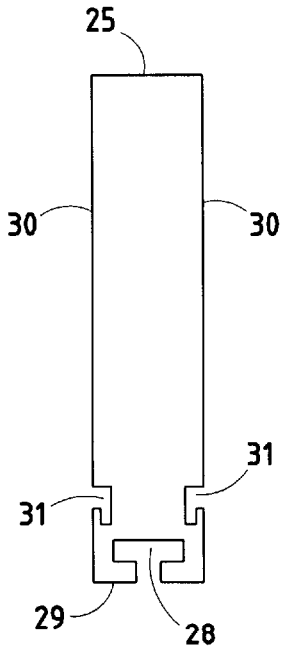
FIG. 8 is a vertical cross-sectional view of the beam.

In the illustrated embodiments of the present invention, as best shown in FIGS. 7–9, each beam 6 has a single T-shaped channel 28 which extends along the entire bottom surface 29 of the beam at a laterally central portion thereof. The opposite side faces 30 of beam 6 include inverted L-shaped hanger channels 31 for hanging partition panels, displays, whiteboards, and the like. Each beam 6 also includes a top surface 25, and a pair of ends 26 which are configured to be attached to the support columns 8 adjacent the upper ends 11 thereof, as described in greater detail hereinafter. The top surfaces 25 of beams 6 may also be provided with a T-shaped channel (not shown), similar to channel 28. Beams 6 are provided in a variety of different lengths to facilitate constructing the desired overhead framework 7.

Figure 2A:
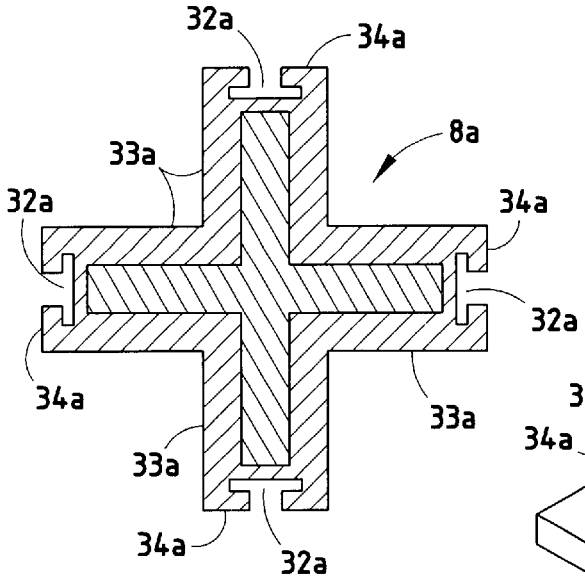
FIG. 2A is a horizontal cross-sectional view of an X-shaped support column portion of the prefabricated furniture system.
Figure 2B:
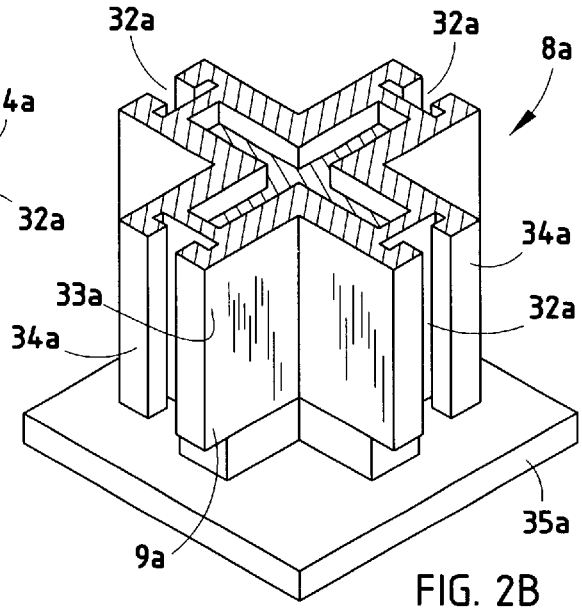
FIG. 2B is a fragmentary perspective view of the X-shaped support column.
Figure 2C:
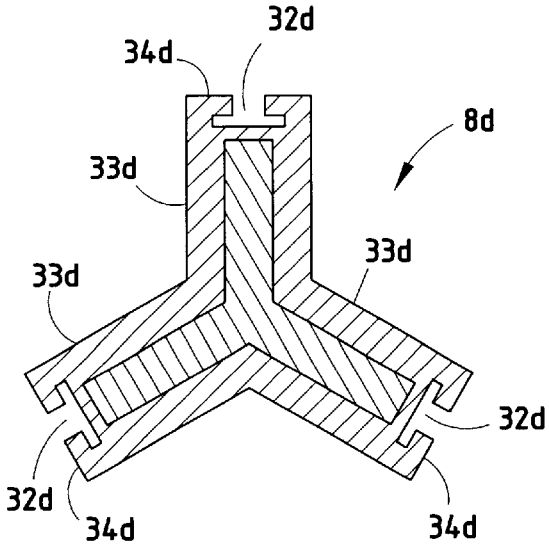
FIG. 2C is a horizontal cross-sectional view of a Y-shaped support column portion of the prefabricated furniture system.
Figure 2D:
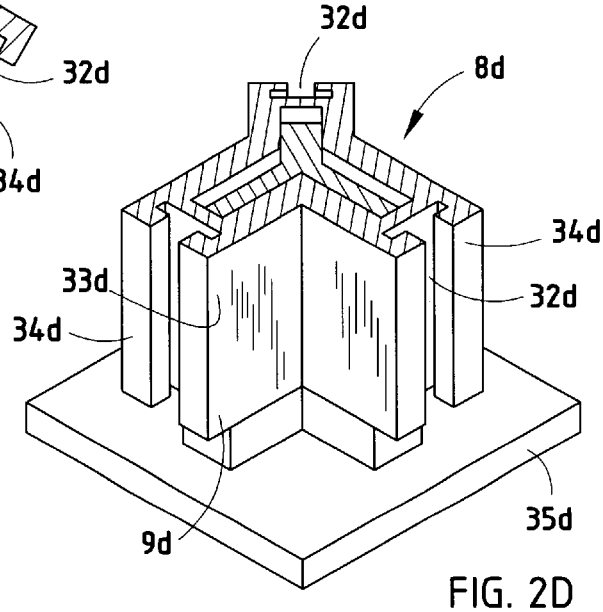
FIG. 2D is a fragmentary perspective view of the Y-shaped support column.
Figure 3:
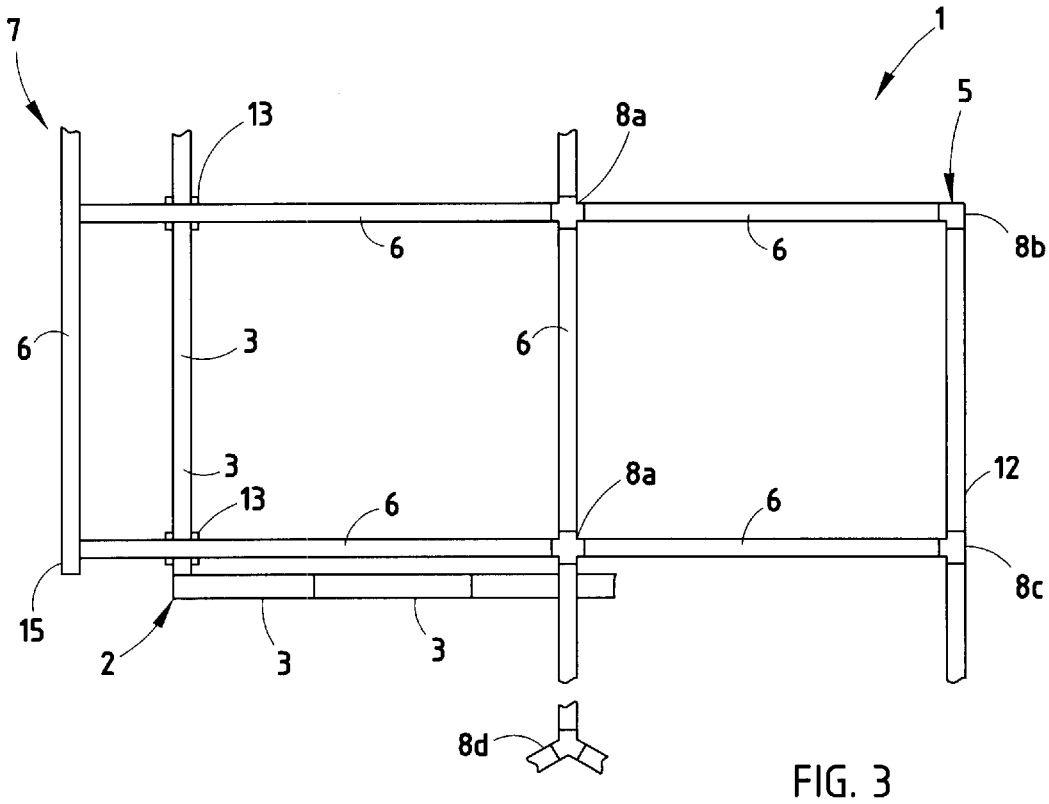
FIG. 3 is a partially schematic, fragmentary top plan view of the prefabricated furniture system.

The support columns 8 (FIG. 1) associated with the illustrated post and beam furniture system 5 are provided in T, X, L and Y configurations, wherein each projecting leg or flange of the support columns 6 includes a T-shaped channel 32, which is substantially identical in shape to the T-shaped channels 28 in beams 6. For example, an X-shaped support column 8*a* is illustrated in FIGS. 2A and 2B, which incorporates four protecting legs or flanges 33*a* which are disposed mutually perpendicularly to define a cruciform shape. The end face 34*a* of each of the flanges 33*a* incorporates a T-shaped channel 32*a* along the entire length thereof. The illustrated support column 8*a* includes a vertically adjustable telescoping foot 35*a* to facilitate leveling the overhead framework 7. A Y-shaped support column 8*d* is illustrated in FIGS. 2C and 2D, which incorporates three projecting legs or flanges 33*d* which are disposed 120 degrees apart to define a Y-shape. The end face 34*d* of each of the flanges 33*d* incorporates a T-shaped channel 32*d* along the entire length thereof. The illustrated support column 8*d* also includes a vertically adjustable telescoping foot 35*d* to facilitate leveling the post and beam furniture system 5 on floor surface 10. The T-shaped support columns 8*c* (FIG. 3) and the L-shaped support columns 8*b* are similarly configured. It is to be understood that other shapes of support columns 8 are also contemplated.

Figure 10:
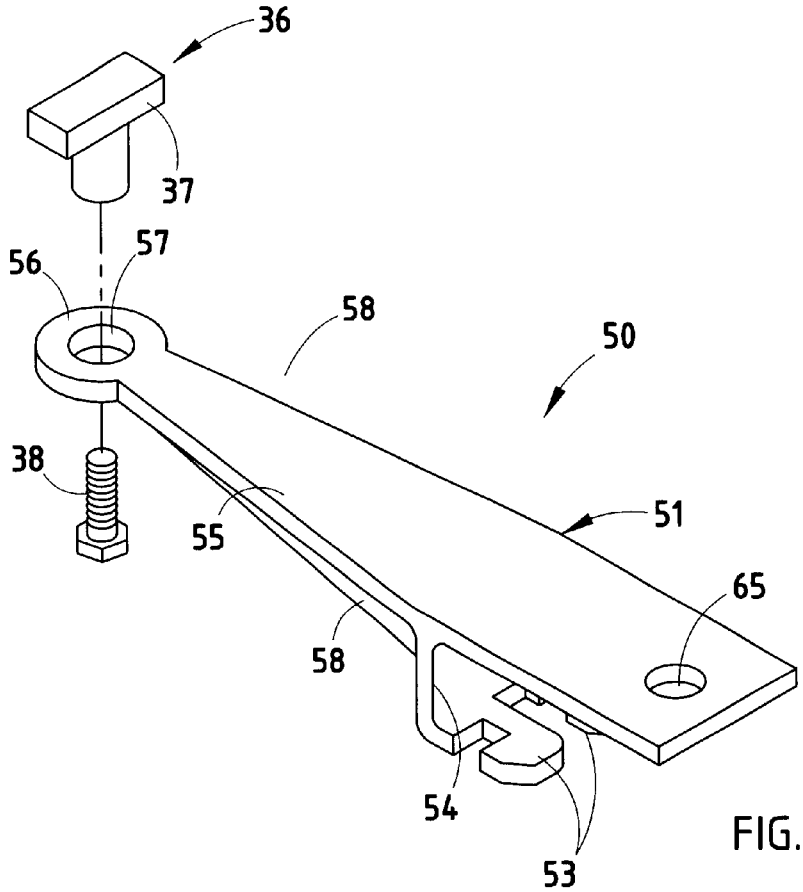
FIG. 10 is a perspective view of a first beam-to-panel bracket.
Figure 11:
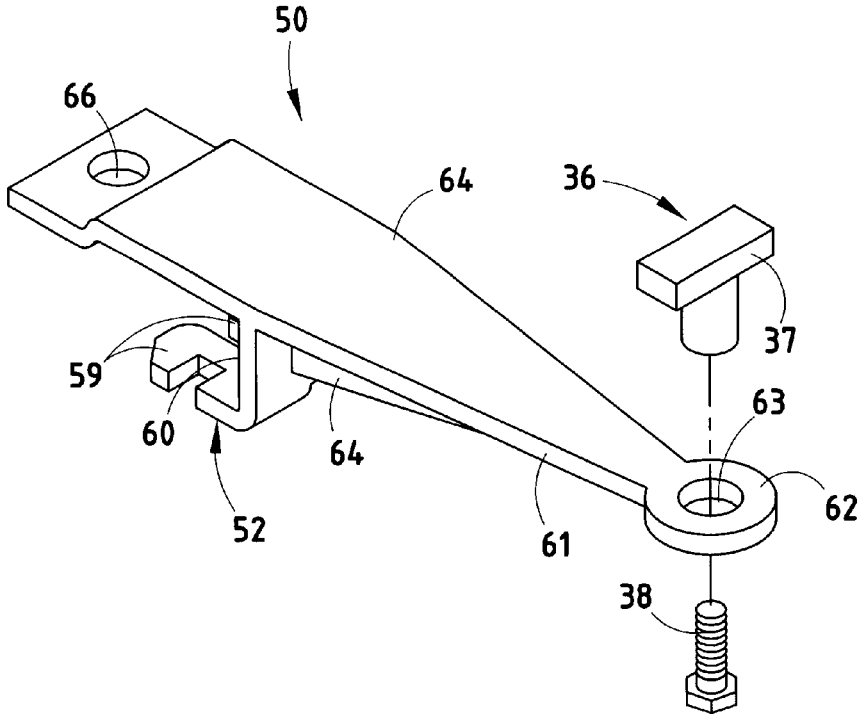
FIG. 11 is a perspective view of a second beam-to-panel bracket.

As best illustrated in FIGS. 2A–2D and 8, each of the T-shaped channels 28 and 32 has a similar T-shaped lateral cross-sectional configuration which is adapted to detachably receive and capture mating fasteners therein, such as the T-fastener 36 illustrated in FIGS. 10 and 11, which includes a T-shaped head 37 and a threaded bolt 38. The head 37 of T-fastener 36 is shaped to be received through the open ends of T-shaped channels 28 and 32, and then rotated approximately 90 degrees to be captured therein. It is to be understood that other types of fasteners may be used to retain accessories and the like in the T-shaped channels 28 and 32 of beams 6 and support columns 8.

As previously noted, the ends 26 of beams 6 are configured to be detachably connected with the upper ends 11 of the associated support columns 8. Preferably, fasteners (not shown) such as the illustrated T-fasteners 36 are retained in the T-shaped channels 32 at the upper ends 11 of support columns 8 and connect with the ends 26 of the beams 6.

In the furniture system 1 shown in FIG. 1, up lighting units 67 are provide along the upper surfaces of beams 6, and lighting units 68 are mounted to the upper portions of partition panels 3.

Connector system 13 includes beam-to-panel brackets 50 (FIGS. 10 and 11) which are used to detachably mount the cantilevered ends of beams 6 to the tops of freestanding partition panels 3 in the fashion described in greater detail hereinbelow. The illustrated beam-to-panel brackets 50 include two mating bracket halves 51 and 52. Bracket 51 includes a pair of in-turned teeth 53 adjacent the inner end thereof, which are adapted to be closely received in the slots 23 of an associated freestanding panel frame 20. Bracket 51 also includes an upstanding end wall 54, and a horizontally oriented support arm 55 with a circular eyelet 56 at the outer end thereof. Eyelet 56 defines a central aperture 57 shaped to receive a T-fastener 36 therethrough. A triangular reinforcing rib or gusset 58 extends along the lower surface of arm 55 between end wall 54 and eyelet 56 to rigidify bracket 51. The inner end of support arm 55 protrudes over bracket teeth 53, and includes a vertically oriented fastener aperture 65 adjacent the terminal portion thereof.

Bracket 52 (FIG. 11) is similar to bracket 51, and also includes a pair of in-turned teeth 59 at the inner end thereof, an upstanding end wall 60 and a horizontally extending support arm 61 with an eyelet 62 at the outer end thereof, with a vertically extending fastener aperture 63. A triangular reinforcing rib or gusset 64 extends along the lower surface of arm 61 between end wall 60 and eyelet 62 to rigidify bracket 52. The inner end of support arm 61 protrudes over bracket teeth 59, and includes a vertically offset terminal portion with a vertically oriented fastener aperture 66. Brackets 51 and 52 may be provided with interlocking members (not shown), such as mating tongue and groove portions to positively lock the same together during use. Preferably, brackets 51 and 52 include safety locks, such as that disclosed in U.S. Pat. No. 6,082,065 to positively retain teeth 53 and 59 in their associated panel frames 20.

Figure 12:
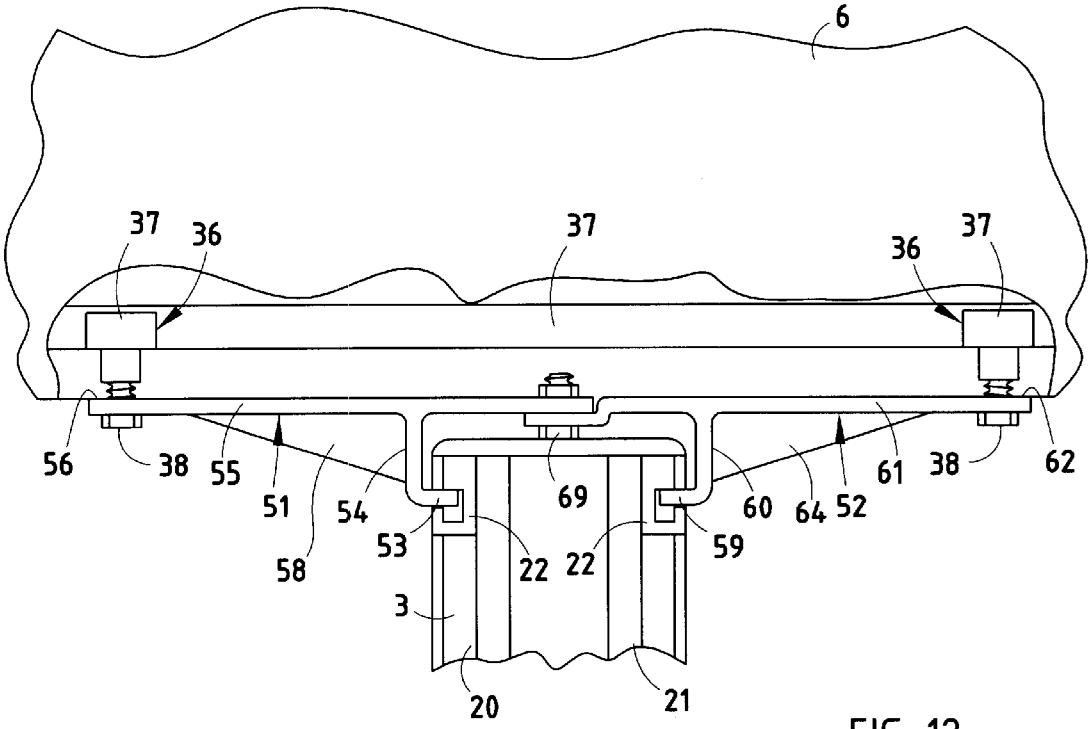
FIG. 12 is a fragmentary vertical cross-sectional view of the beam-to-panel brackets shown connecting an overhead beam to a partition panel.
Figure 13:
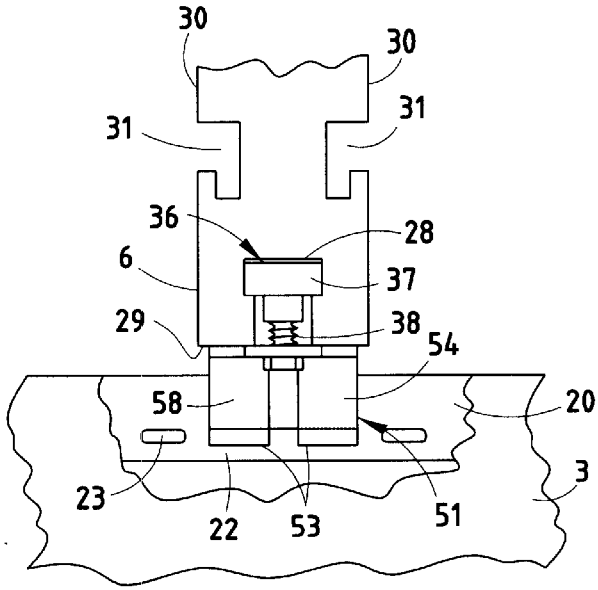
FIG. 13 is a fragmentary view of the beam-to-panel brackets shown in FIG. 12, with portions thereof broken away to reveal internal construction.

In the example illustrated in FIGS. 12 and 13, brackets 51 and 52 are used to attach the cantilevered ends 15 of beams 6 to the frames 20 of freestanding partition panels 3 in the following manner. The teeth 53 and 59 on brackets 51 and 52 are inserted into the slots 23 extending along the opposite sides of the upper portion of panel frame 20, and locked securely into place. Fastener apertures 65 and 66 are thusly positioned in vertical alignment, and a fastener 69 (FIG. 12) is inserted therethrough and tightened to positively interconnect brackets 51 and 52 at their inner ends. The opposing eyelets 56 and 62 at the outer ends of brackets 51 and 52 are positioned in vertical alignment with the T-channel 28 extending along the bottom of associated beam 6. A T-shaped fastener 36 is then inserted through each of the fastener apertures 57 and 63 in brackets 51 and 52, and the T-shaped head 37 is inserted through the open end of the T-shaped channel 28 along the bottom of associated beam 6, and then rotated 90 degrees to capture the same therein. The bolts 38 are then tightened to securely connect beam 6 to the freestanding partition panel 3. It is to be understood that other types of brackets and/or connectors may be used to detachably connect beams 6 to the upper ends 14 of partition panels 3.

Figure 4:
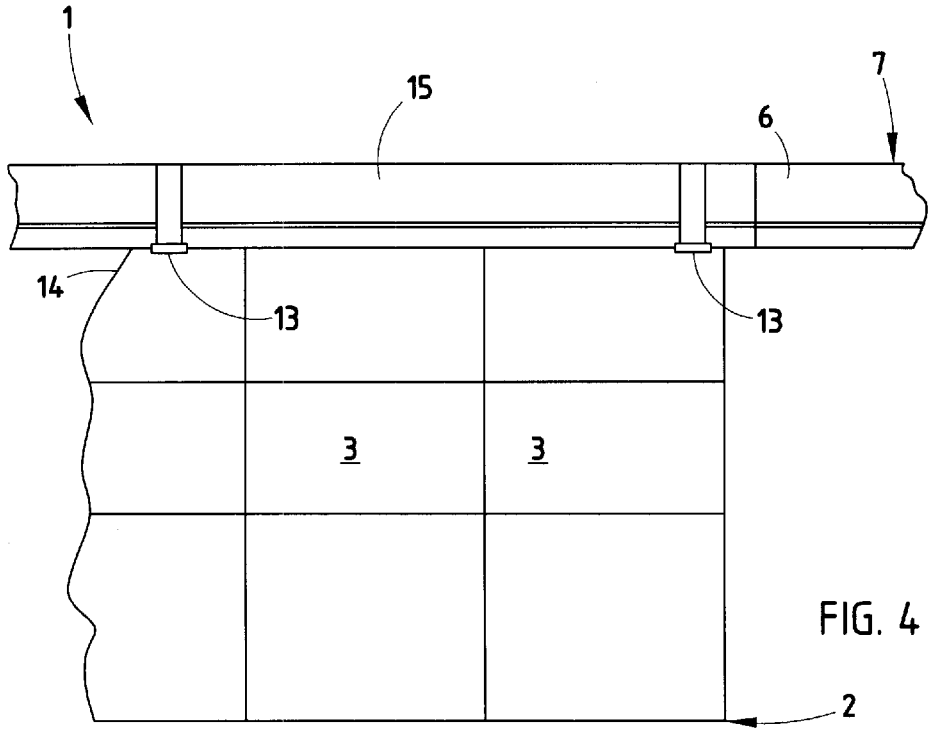
FIG. 4 is a partially schematic, fragmentary front elevational view of the prefabricated furniture system.
Figure 4A:
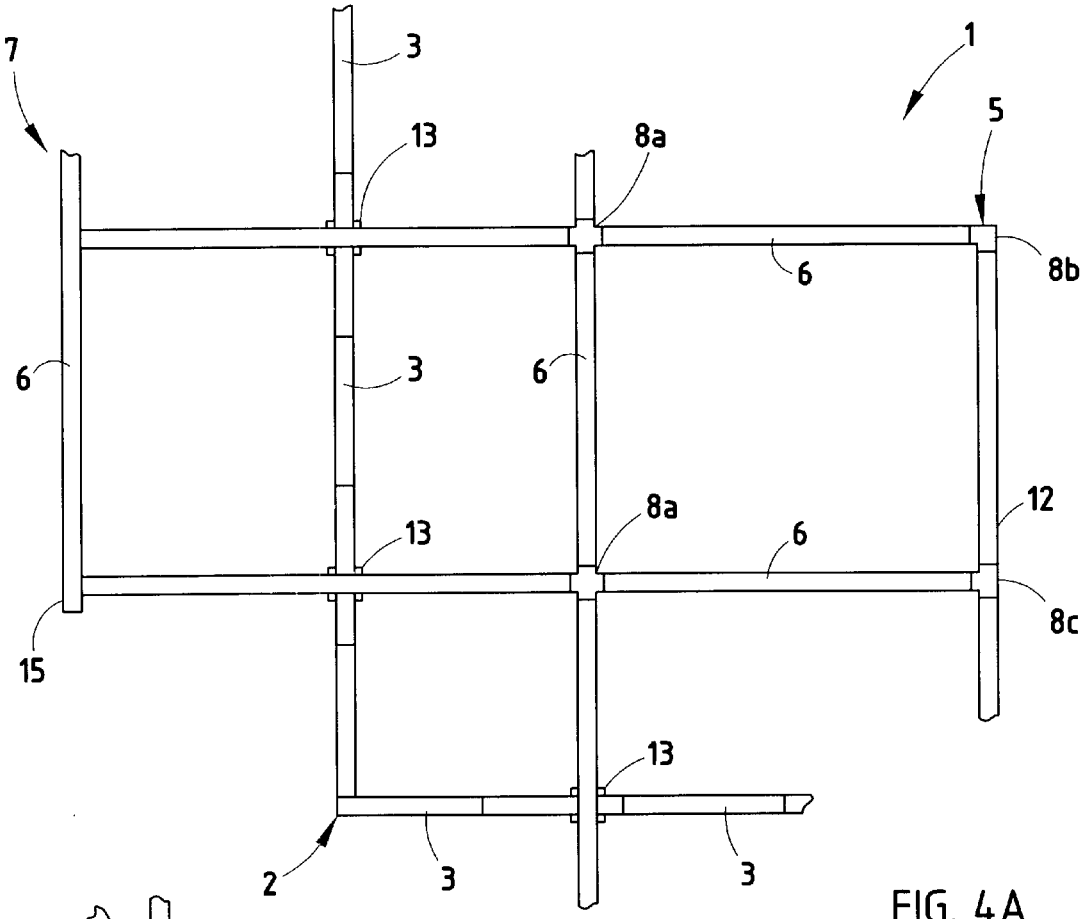
FIG. 4A is a partially schematic, fragmentary top plan view of an alternative configuration of the prefabricated furniture system.
Figure 4B:
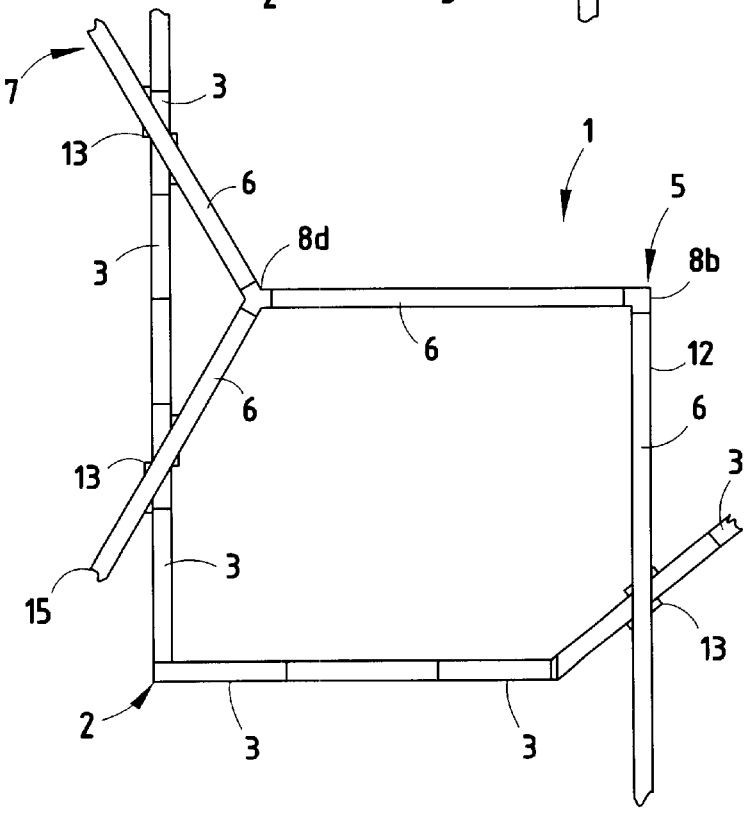
FIG. 4B is a partially schematic, fragmentary top plan view of another alternative configuration of the prefabricated furniture system.

Connector system 13 permits freestanding portable partition system 2 and post and beam furniture system 5 to be independently planned and positioned in the open space to achieve maximum workstation efficiency for any given floor space, and interconnects the same in a wide variety of different angular and spatial relationships to create a fully integrated furniture system. For example, in the configuration shown in FIG. 3, overhead framework 7 is oriented so that beams 6 extend generally perpendicularly relative to partition panels 3, with the cantilevered portion of overhead framework 7 located relatively near the corner of the two intersecting runs of partition panels 3. In the configuration shown in FIG. 4A, the beams 6 of overhead framework 7 are also oriented generally perpendicular relative to partition panels 3, but the same have been shifted both in a side-to-side direction, and in a fore-to-aft direction to create a larger cantilevered area, and to move overhead framework 7 away from the corner of the two intersecting runs of partition panels 3. In the configuration shown in FIG. 4B, overhead framework 7 is oriented so that beams 6 extend over partition panels 3 in an angled or non-perpendicular fashion. Beam-to-panel brackets 51 and 52 can be used to interconnect beams 6 with partition panels 3 in a wide variety of different angular orientations and lateral locations. Consequently, the positioning of partition panels 3 in a selected space does not dictate or control the positioning of support columns 8 or beams 6, and the positioning of support columns 8 and/or beams 6 does not dictate or control the location of partition panels 3. Both portable partition system 2 and post and beam furniture system 5 can be planned independently for any given floor space, yet are interconnectable through connector system 13 to provide complete integration and increased flexibility.

Figure 14:
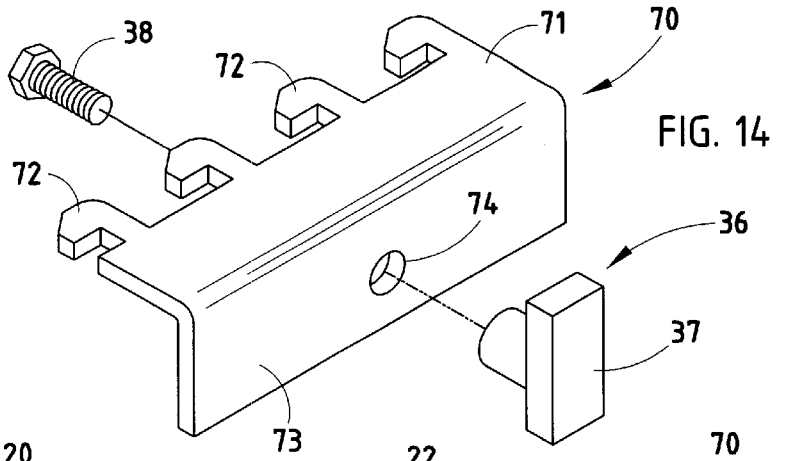
FIG. 14 is an exploded perspective view of a panel stabilizer connector.
Figure 15:
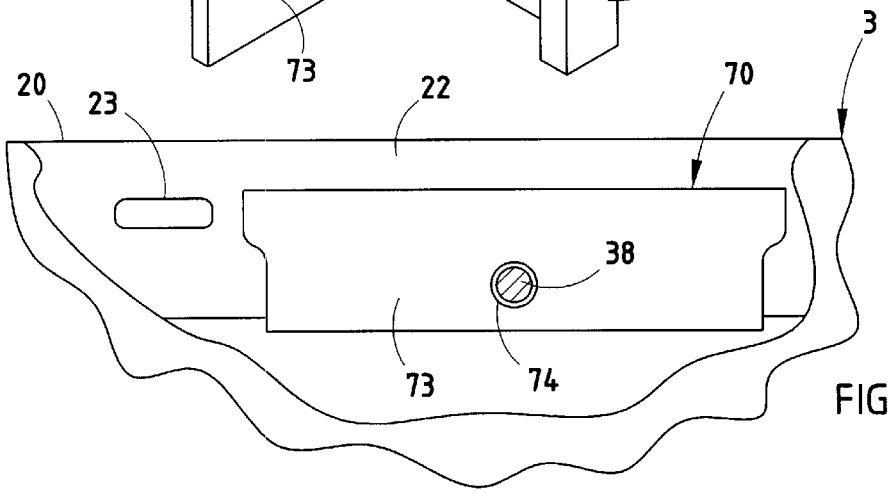
FIG. 15 is a front elevational view of the panel stabilizer connector, shown attached to an adjacent partition panel.
Figure 16:
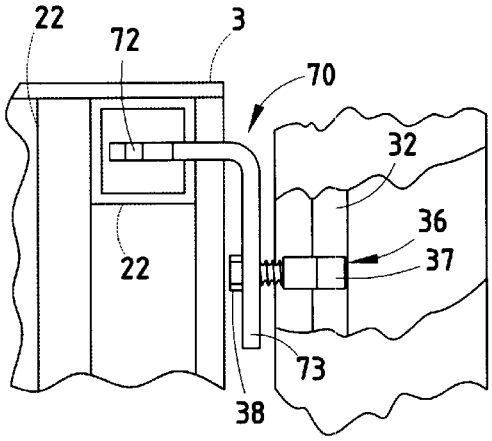
FIG. 16 is a side elevational view of the panel stabilizer connector, shown attached to an adjacent support column.
Figure 17:
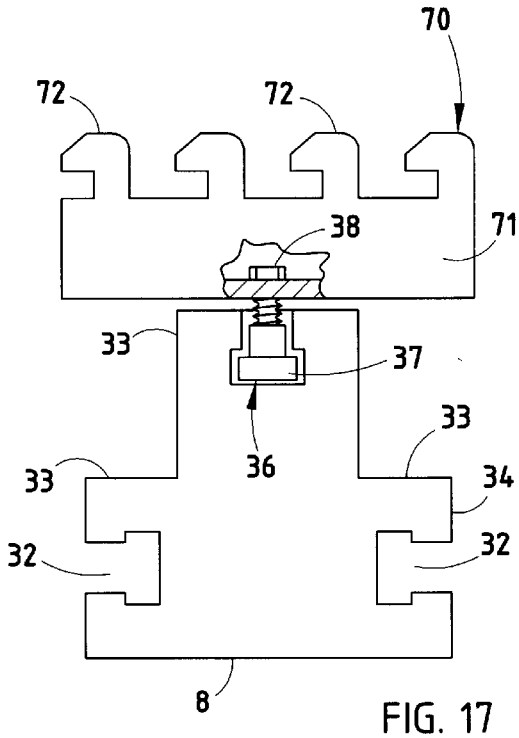
FIG. 17 is a top plan view of the panel stabilizer connector, shown attached to an adjacent support column.

With reference to FIGS. 14–16, a panel stabilizer connector bracket 70 is provided to attach one or more of the partition panels 3 with a vertical side of an adjacent one of the support columns 8 to provide lateral rigidity to the partition system 2. In the illustrated example, stabilizer bracket 70 has a generally inverted L-shaped configuration, and includes an upper flange 71 with four teeth 72 extending along the length thereof. Stabilizer bracket 70 also includes a lower flange 73 with a centrally located fastener aperture 74 extending in a horizontal orientation. As noted above, a safety lock (not shown) is preferably provided to positively retain teeth 72 in the associated panel frame 20.

In operation, stabilizer bracket 70 is attached to the frame 20 of an associated partition panel 3 by inserting teeth 72 into the slots 23 of an associated panel frame 20. A T-fastener 36 is then used to attach stabilizer bracket 70 to an adjacent support column 8 by inserting the head 37 of T-fastener 36 into the support column channel 32, rotating the same 90 degrees to capture the same therein, and then tightening bolt 38, as shown in FIG. 16.

In assembling prefabricated furniture system 1 in an open floor plan, freestanding partition panels 3 are interconnected side-by-side in a conventional fashion to define individual workstations 4. The post and beam furniture system 5 is also assembled, with beams 6 being attached to the upper ends of support columns 8 at the first end 12 of overhead framework 7. The support columns 8 are positioned at preselected locations on the floor surface 10, and retain the first end 12 of the overhead framework 7 a predetermined spaced apart distance above the floor surface and below the ceiling. The opposite end 15 of overhead framework 7 is supported on the top of the freestanding partition panels 3, such that the horizontal beams 6 at that end 15 of overhead framework 7 extend over and protrude outwardly from the partition panels 3 and are supported thereby in a cantilevered fashion. As previously noted, brackets 51 and 52 are attached to the slotted horizontal rails 22 in panel frames 20, and then connected with the cantilevered beams 6 by T-fasteners 36. Freestanding partition panels 3 can be laterally stabilized by using stabilizer brackets 70 to attach the freestanding panels 3 to an adjacent support column 8 in the manner described hereinabove.

In the foregoing description, it will be readily appreciated by those skilled in the art that modifications may be made to the invention without departing from the concepts disclosed herein. Such modifications are to be considered as included in the following claims unless these claims by their language expressly state otherwise.

What is claimed is:

1. A prefabricated furniture system for open building plans of the type having a ceiling and a floor surface, comprising:

a freestanding portable partition system including a plurality of individual partition panels having lower ends thereof abuttingly supported on the floor surface, upper ends thereof spaced apart from the ceiling, and opposite sides detachably interconnected in a side-by-side fashion to define individual workstations;

a post and beam furniture system including a plurality of horizontal beams interconnected to define an overhead framework with first and second end portions, and a plurality of vertical support columns having lower ends thereof abuttingly supported on the floor surface, and upper ends thereof connected with said overhead framework adjacent at least said first end portion thereof to support said first end portion of said overhead framework on said columns a predetermined spaced apart distance above the floor surface and below the ceiling; and a connector system connecting said overhead framework to said upper ends of said partition panels at a location spaced inwardly from said second end portion of said overhead framework, such that said horizontal beams at said second end portion of said overhead framework extend over and protrude outwardly from said partition panels and are supported thereon in a cantilevered fashion.

2. A prefabricated furniture system as set forth in claim 1, wherein:

said connector system includes beam-to-panel brackets, each having a first portion thereof configured to be attached to said overhead framework at multiple locations thereon, and a second portion thereof configured to be attached to said partition panels at multiple locations thereon, such that said overhead framework can be supported on said partition system in a variety of different angular and spatial relationships.

3. A prefabricated furniture system as set forth in claim 2, including:

a panel stabilizer connector detachably connecting at least one of said partition panels with a vertical side of an adjacent one of said support columns to provide lateral rigidity to said partition system.

4. A prefabricated furniture system as set forth in claim 3, wherein:

said partition panels include interior frames with feet supported directly on the floor surface; and said beam-to-panel brackets connect said overhead framework directly to said interior frames to transmit loads through said feet to the floor surface.

5. A prefabricated furniture system as set forth in claim 4, wherein:

each of said interior frames has at least one row of slots along an upper portion thereof; and each of said beam-to-panel brackets has teeth shaped to be received in said slots.

6. A prefabricated furniture system as set forth in claim 5, wherein:

each of said horizontal beams has a T-shaped channel extending longitudinally along a bottom surface thereof in which said beam-to-panel brackets are detachably retained.

7. A prefabricated furniture system as set forth in claim 6, wherein:

each of said support columns has a T-shaped channel extending vertically along at least one side face thereof in which said panel stabilizer connector is detachably retained.

8. A prefabricated furniture system as set forth in claim 7, wherein:

each of said beam-to-panel brackets includes first and second mating portions which extend over and span the width of an adjacent one of said partition panels, and have teeth connected with said slots on the opposite sides of said one partition panel.

9. A prefabricated furniture system as set forth in claim 8, wherein:

at least said one partition panel has a top trim cap; and said beam-to-panel brackets are configured to position the bottom surfaces of said horizontal beams protruding over said partition panels a spaced apart distance above said top trim cap.

10. A prefabricated furniture system as set forth in claim 9, wherein:

said connector system includes T-shaped fasteners configured to be received in the T-shaped channels in said horizontal beams and said support columns.

11. A prefabricated furniture system as set forth in claim 10, wherein:

said panel stabilizer connector includes panel-to-post brackets with teeth shaped to be received in said slots.

12. A prefabricated furniture system as set forth in claim 11, wherein:

said first and second mating portions of said beam-to-panel brackets include interlocking members for increased rigidity and strength.

13. A prefabricated furniture system as set forth in claim 12, wherein:

at least one of said first and second mating portions of each of said beam-to-panel brackets includes one of said T-shaped fasteners connecting the same with an adjacent one of said horizontal beams.

14. A prefabricated furniture system as set forth in claim 13, wherein:

each of said panel-to-post brackets includes one of said T-shaped fasteners connecting the same with an adjacent one of said support columns.

15. A prefabricated furniture system as set forth in claim 14, wherein:

each of said T-shaped fasteners includes an elongated head shaped to be received through said T-shaped slot in a first rotational orientation, and captured in said T-shaped slot in a second rotational orientation.

16. A prefabricated furniture system as set forth in claim 15, wherein:

said support columns include L-shaped posts, X-shaped posts, T-shaped posts and Y-shaped posts.

17. A prefabricated furniture system as set forth in claim 1, including:

a panel stabilizer connector detachably connecting at least one of said partition panels with a vertical side of an adjacent one of said support columns to provide lateral rigidity to said partition system.

18. A prefabricated furniture system as set forth in claim 1, wherein:

said partition panels include interior frames with feet supported directly on the floor surface; and said connector system connects said overhead framework directly to said interior frames to transmit loads through said feet to the floor surface.

19. A prefabricated furniture system as set forth in claim 1, wherein:

said connector system includes T-shaped channels extending longitudinally along a bottom surface of said horizontal beams.

20. A prefabricated furniture system as set forth in claim 1, wherein:

said connector system includes T-shaped channels extending vertically along at least one side face of said support columns.

21. A prefabricated furniture system as set forth in claim 1, wherein:

said connector system includes T-shaped fasteners configured to be received in T-shaped channels in said horizontal beams and said support columns.

22. A prefabricated furniture system as set forth in claim 21, wherein:

each of said T-shaped fasteners includes an elongated head shaped to be received through said T-shaped slot in a first rotational orientation, and captured in said T-shaped slot in a second rotational orientation.

23. A prefabricated furniture system as set forth in claim 1, wherein:

said support columns include L-shaped posts, X-shaped posts, T-shaped posts and Y-shaped posts.

24. A prefabricated furniture system as set forth in claim 1, wherein:

said horizontal beams include hanger channels extending along opposite side faces thereof.

25. A method for furnishing open building plans of the type having a ceiling and a floor surface, comprising:

providing a freestanding portable partition system including a plurality of individual partition panels having lower ends thereof adapted to be abuttingly supported on the floor surface, and upper ends thereof adapted to be positioned a spaced apart distance from the ceiling;

detachably interconnecting the partition panels in a side-by-side fashion to define individual workstations;

providing a post and beam furniture system including a plurality of horizontal beams interconnected to define an overhead framework with first and second end portions, and a plurality of vertical support columns having lower ends thereof adapted to be abuttingly supported on the floor surface, and upper ends thereof adapted to be connected with said overhead framework;

positioning the support columns at preselected locations on the floor surface, and detachably connecting the upper ends thereof with the horizontal beams at the first end portion of the overhead framework to support the same a predetermined spaced apart distance above the floor surface and below the ceiling; and connecting the overhead framework to the upper ends of the partition panels at a location spaced inwardly from the second end portion of the overhead framework, such that the horizontal beams at the second end portion of the overhead framework extend over and protrude outwardly from the partition panels and are supported thereon in a cantilevered fashion.

26. A method as set forth in claim 25, including:

providing a panel stabilizer connector; and detachably connecting the panel stabilizer connector with one of the partition panels and a vertical side of an adjacent one of the support columns to provide lateral rigidity to the partition system.

27. A method as set forth in claim 26, wherein:

said connecting step includes attaching beam-to-panel brackets to the horizontal beams and interior frame portions of the partition panels, such that the weight of the overhead framework is supported directly on the floor surface through the interior frame portions.

28. A method as set forth in claim 27, including:

forming T-shaped channels in the lower surfaces of the horizontal beams; and wherein said connecting step includes detachably mounting T-shaped fasteners in the T-shaped channels of the horizontal beams and connecting the same with the partition panels.

29. A method as set forth in claim 28, including:

forming T-shaped channels in at least one vertical face of the support columns; and wherein:

said panel stabilizer connector connecting step includes detachably mounting T-shaped fasteners in the T-shaped channels of the support columns.

30. A prefabricated furniture system for open building plans of the type having a ceiling and a floor surface, comprising:

a freestanding portable partition system including a plurality of individual partition panels having lower ends thereof abuttingly supported on the floor surface, upper ends thereof spaced apart from the ceiling, and opposite sides detachably interconnected in a side-by-side fashion to define individual workstations; at least one of said partition panels has an interior frame with at least one row of slots along an upper portion thereof;

a post and beam furniture system including a plurality of horizontal beams interconnected to define an overhead framework, and a plurality of vertical support columns having lower ends thereof abuttingly supported on the floor surface, and upper ends thereof connected with said overhead framework to support said overhead framework on said columns a predetermined spaced apart distance above the floor surface and below the ceiling; and a panel stabilizer connector having teeth received in said slots of said one partition panel to detachably connect said one partition panel with a vertical side of an adjacent one of said support columns to provide lateral rigidity to said partition system.

31. A prefabricated furniture system as set forth in claim 30, wherein:

each of said partition panels has an interior frame with at least one row of slots along an upper portion thereof.

32. A prefabricated furniture system as set forth in claim 31, wherein:

each of said support posts has a T-shaped channel extending vertically along at least one side face thereof in which said panel stabilizer connector is detachably retained.

33. A prefabricated furniture system as set forth in claim 32, wherein:

said panel stabilizer connector includes T-shaped fasteners configured to be received in the T-shaped channels in said support posts.

34. A prefabricated furniture system as set forth in claim 33, wherein:

said panel stabilizer connector includes a plurality of panel-to-post brackets.

35. A prefabricated furniture system as set forth in claim 34, wherein:

each of said T-shaped fasteners includes an elongated head shaped to be received through said T-shaped slot in a first rotational orientation, and captured in said T-shaped slot in a second rotational orientation.

36. A prefabricated furniture system as set forth in claim 35, wherein:

said support columns include L-shaped posts, X-shaped posts, T-shaped posts and Y-shaped posts.

37. A method for furnishing open building plans of the type having a ceiling and a floor surface, comprising:

providing a freestanding portable partition system including a plurality of individual partition panels having lower ends thereof adapted to be abuttingly supported on the floor surface, and upper ends thereof adapted to be positioned a spaced apart distance from the ceiling;

detachably interconnecting the partition panels in a side-by-side fashion to define individual workstations;

providing a post and beam furniture system including a plurality of horizontal beams interconnected to define an overhead framework, and a plurality of vertical support columns having lower ends thereof adapted to be abuttingly supported on the floor surface, and upper ends thereof adapted to be connected with said overhead framework;

forming T-shaped channels in at least one vertical face of at least one of the support columns;

positioning the support columns at preselected locations on the floor surface, and detachably connecting the upper ends thereof with the horizontal beams to support the same a predetermined spaced apart distance above the floor surface and below the ceiling; and detachably connecting a panel stabilizer connector with at least one of the partition panels by mounting T-shaped fasteners in the T-shaped channels of the one support column to provide lateral rigidity to the partition system.

38. A method as set forth in claim 37, including:

forming T-shaped channels in each vertical face of each of the support columns.

* * * * *